United States Patent [19]

Kamata

[11] Patent Number: 4,930,462

[45] Date of Patent: Jun. 5, 1990

[54] SEPARATED LUBRICATION TYPE TWO-CYCLE INTERNAL COMBUSTION ENGINE SYSTEM

[75] Inventor: Yoshikiyo Kamata, Hachioji, Japan

[73] Assignee: Kioritz Corporation, Tokyo, Japan

[21] Appl. No.: 361,886

[22] Filed: Jun. 6, 1989

[30] Foreign Application Priority Data

Jul. 1, 1988 [JP] Japan ..... 63-87494[U]

[51] Int. Cl.[5] ..... F02B 33/04

[52] U.S. Cl. ..... 123/73 AD; 123/196 R; 184/6.18

[58] Field of Search ..... 123/73 AD, 196 R, 196 CP; 184/6.18, 6.28

[56] References Cited

U.S. PATENT DOCUMENTS

| | | | |
|---|---|---|---|
| 3,707,143 | 12/1972 | Reese et al. | 123/73 C |
| 3,809,185 | 5/1974 | Kobayashi et al. | 184/15 R |
| 4,231,716 | 11/1980 | Kubota et al. | 417/315 |
| 4,411,225 | 10/1980 | Dell'Orto | 123/73 AD |
| 4,475,488 | 10/1984 | Odashima | 123/73 AD |
| 4,827,881 | 5/1989 | Baker et al. | 123/196 R |

FOREIGN PATENT DOCUMENTS

| | | | |
|---|---|---|---|
| 676043 | 5/1939 | Fed. Rep. of Germany | 123/196 R |
| 3025002 | 2/1981 | Fed. Rep. of Germany | 123/73 AD |
| 2437491 | 5/1980 | France | 123/73 AD |
| 0131808 | 8/1982 | Japan | 123/196 R |
| 479877 | 11/1975 | U.S.S.R. | 123/73 AD |

*Primary Examiner*—David A. Okonsky
*Attorney, Agent, or Firm*—Browdy & Neimark

[57] ABSTRACT

A separated lubrication type two-cycle internal combustion engine system having: a lubricating oil pump capable of discharging lubricating oil at a rate higher than the rate at which an internal combustion engine needs to be lubricated, the lubricating oil pump being disposed in the vicinity of one of projecting ends of a crankshaft and having an inlet communicating with a lubricating oil tank and a pair of outlets one of which communicates with the interior of the internal combustion engine and the other of which communicates with the lubricating oil tank; and a drive member disposed at the one of the projecting ends of the crankshaft to drive the lubricating oil pump by the torque of the engine.

1 Claim, 3 Drawing Sheets

SEPARATED LUBRICATION TYPE TWO-CYCLE INTERNAL COMBUSTION ENGINE SYSTEM

BACKGROUND OF THE INVENTION

This invention relates to a separated lubrication type two-cycle internal combustion engine system.

A separated lubrication type of two-cycle internal combustion engine in which fuel and lubricating oil are supplied separately from each other can be easily handled since there is no need for preparing a fuel in which a lubricating oil is previously mixed. Ordinarily, in conventional internal combustion engine systems of this type, the whole of lubricating oil discharged from a lubricating oil pump at a rate slightly higher than the required rate is supplied to the internal combustion engine in consideration of prevention of failure to sufficiently supply the oil. The lubricating oil is therefore consumed at a considerable rate. Moreover, a considerably large space is required to dispose the lubricating oil with a device for driving the lubricating oil pump because the lubricating oil pump is disposed at a distance from the internal combustion engine. It is therefore difficult to reduce the overall system in size and weight.

SUMMARY OF THE INVENTION

An object of the present invention is to provide a simple and convenient two-cycle internal combustion engine of a separated lubrication type free from aforesaid problems of the conventional art.

To this end, the present invention provides a separated lubrication type two-cycle internal combustion engine system having: a lubricating oil pump capable of discharging lubricating oil at a rate higher than the rate at which an internal combustion engine needs to be lubricated, the lubricating oil pump being disposed in the vicinity of one of projecting ends of a crankshaft, the lubricating oil pump having an inlet communicating with the lubricating oil tank and a pair of outlets one of which communicates with the interior of the internal combustion engine and the other of which communicates with the lubricating oil tank; and a drive member disposed at the one of the projecting ends of the crankshaft is drivingly connected with the lubricating oil pump.

In accordance with the present invention, the lubricating oil pump can be disposed in a comparatively small space adjacent to the crankcase, and the lubricating oil pump is capable of supplying the lubricating oil to the internal combustion engine at a minimized rate with improved reliability while enabling reuse of excess part of the discharged lubricating oil by returning the same to the lubricating oil tank.

Thus, the arrangement of the present invention enables reductions in the overall size and the weight of the engine system by disposing the lubricating oil pump in a comparatively small space adjacent to the crankcase, and also enables the internal combustion engine to be positively supplied with the lubricating oil at a necessary and sufficient rate without using any special micropump, while the desired lubrication performance is maintained by returning excess lubricating oil to the lubricating oil tank and by making the lubricating oil constantly circulate. The problem of wasteful consumption of lubricating oil is thereby eliminated, and stable and economical performance of the system is achieved.

DESCRIPTION OF THE PREFERRED EMBODIMENTS

Figure 1:
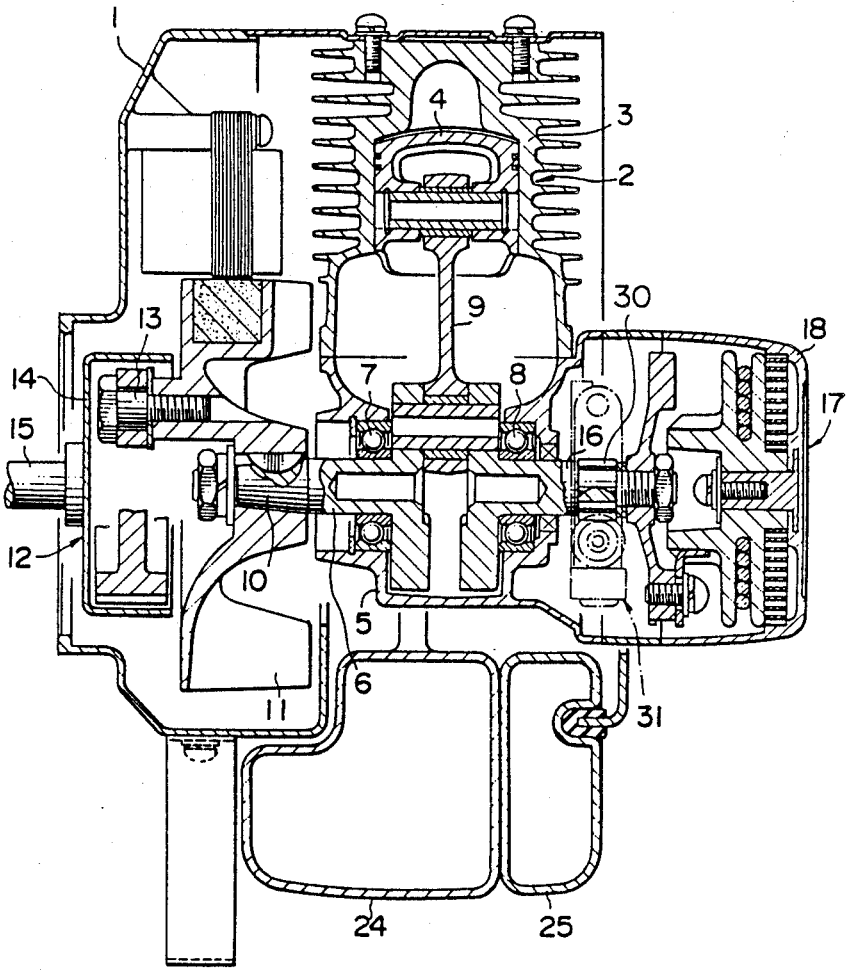
FIG. 1 is a longitudinal sectional view of essential portions of a separated lubrication two-cycle internal combustion engine system for a power grass trimmer which represents an embodiment of the present invention.

An embodiment of the present invention will be described with reference to the accompanying drawings.

In the illustrated embodiment, the present invention is applied to a separated lubrication two-cycle internal combustion engine system for a grass trimmer. This system has an air cooled two-cycle internal combustion engine 2 mounted in an engine case piston 4 reciprocatively movably disposed in the cylinder 3, a crankcase 5 connected to the cylinder 3, a crankshaft 6 rotatably supported by bearings 7 and 8 on the crankcase 5, and a connecting rod 9 connecting the piston 4 and the crankshaft 6. The crankshaft 6 is rotated by the reciprocating motion of the piston 4. A coiling fan 11 is attached to the output end, i.e., the front end 10 of the crankshaft 6 projecting outside the crankcase 5. During operation, the cooling fan 11 draws outside air into the engine case 1 and cools the cylinder 3 by blowing cooling air thereto. A centrifugal clutch 12 is provided in front of the cooling fan 11. A driving-side member 13 of the centrifugal clutch 12 is attached to the cooling fan 11 while a driving-side member 14 of the centrifugal clutch 12 is connected to a transmission shaft 15 disposed coaxially with the crankshaft 6 and extending forward. The transmission shaft 15 extends inside an operation rod (not shown) of the grass trimmer and is connected to a grass cutting device (not shown) connected to the front end of the operation rod. The torque or driving force of the internal combustion engine 2 is transmitted to the grass cutting device through the transmission shaft 15 to cut grass by rotating a cutting blade.

A starter 17 is disposed in the vicinity of a rear end 16 of the crankshaft 6 opposite to the front end 10 projecting outside the crankcase 5. The starter 17 is of an ordinary recoil type and has a starter case 18 attached to the engine case 1.

A fuel tank 24 and a lubricating oil tank 25 are disposed side by side and mounted to a lower wall of the engine case 1. Fuel in the fuel tank 24 is supplied to a carburetor 19 by a diaphragm type fuel pump 26. Lubricating oil contained in the lubricating oil tank 25 is supplied to the interior of the internal combustion engine 2 separately from the fuel, as described later. The lubricating oil tank 25 has a lubricating oil inlet 28 which is closed by a cap 29 attached in a screwing manner. The fuel tank 24 also has a similar fuel inlet and a cap (not shown) for closing the fuel inlet.

Figure 2:
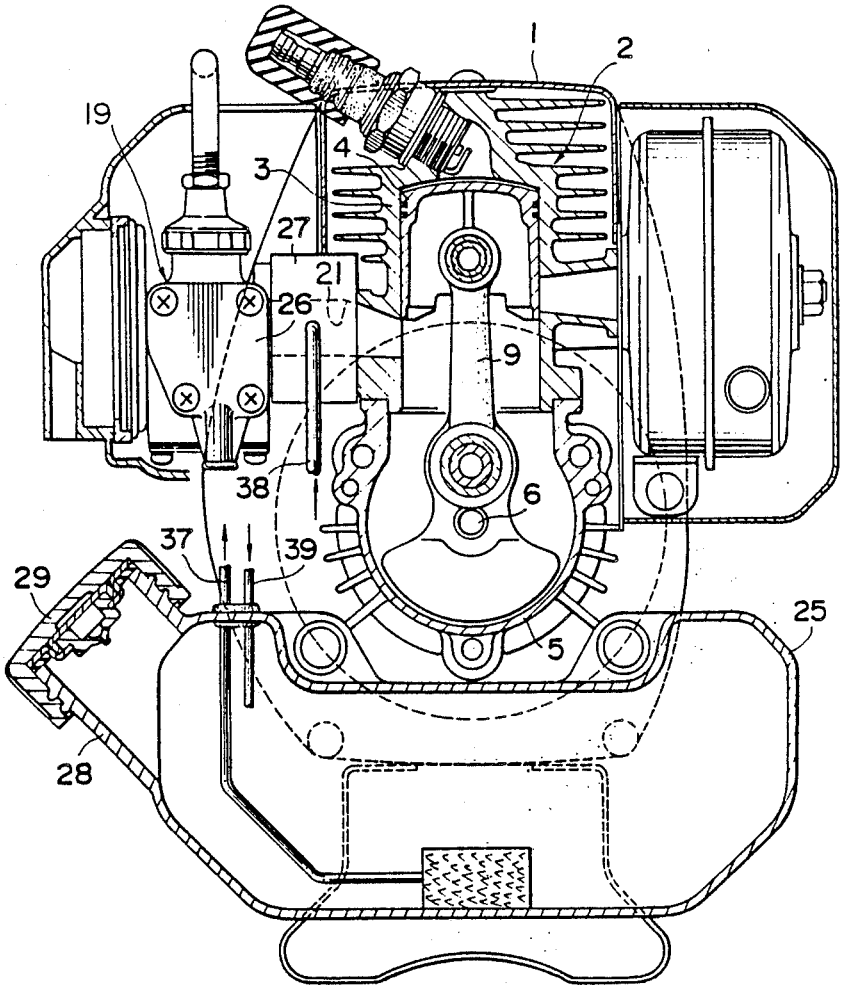
FIG. 2 is a sectional end view of the essential portions shown in FIG. 1.
Figure 3:
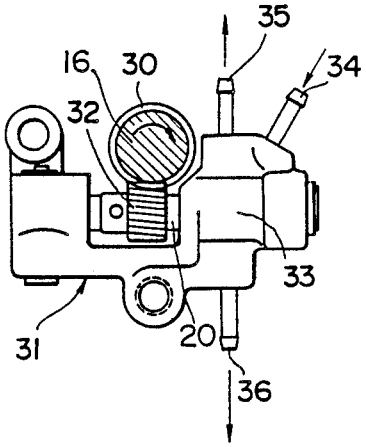
FIG. 3 is a side view of a lubricating oil pump for use in the system shown in FIG. 1.

A worm 30 provided as a driving member is integrally formed on the crankshaft 6 at the rear end 16. The worm 30 meshes with a gear 32 of a lubricating oil pump 31 which is a rotary plunger type of micropump having a main body attached to a rear end wall portion of the crankcase 5. The lubricating oil pump 31 has an inlet 34 through which the lubricating oil is drawn into a pump chamber 33 and a pair of outlets 35 and 36 through which the lubricating oil pressurized by a reciprocating rotary plunger 20 driven integrally with the gear 32 inside the pump chamber 33 is discharged. The inlet 34 communicates with the lubricating oil tank 25 via an inlet pipe 37 (FIG. 2), thereby enabling the lubricating oil to be supplied from the lubricating oil tank 25 to the pump chamber 33. The one outlet 35 communicates, via a discharge pipe 38, with a internal passage 21 of an insulator 27 which provides communication between the carburetor 19 and the interior of the internal combustion engine 2, thereby enabling the lubricating oil to be supplied to the interior of the internal combustion engine 2 under pressure at a predetermined rate. The other outlet 36 communicates with the lubricating oil tank 25 via a return pipe 39 (FIG. 2), thereby enabling excess oil discharged from the pump chamber 33 to be returned to the lubricating oil tank 25. Thus, the lubricating oil pump 31 operates to circulate the lubricating oil in such a manner that it draws the lubricating oil from the lubricating oil tank 25 at a rate larger than the rate at which the internal combustion engine 2 needs to be lubricated, and it returns excess lubricating oil to the lubricating oil tank 25. The rate at which the lubricating oil is discharged through each of the outlets 35 and 36 may be controlled, if necessary, by adjusting a suitable lubricating oil distribution valve means (not shown) such as orifices.

A different arrangement may be provided as another embodiment of the present invention in which the drive member 30 is disposed between the crankcase 5 and the cooling fan 11 at the front end 10 of the crankshaft 6, and in which the lubricating oil pump 31 is disposed at the front end of the crankcase 5.

Preferably, in the case of a two-cycle engine having a displacement of 20 ml, a pump having a discharge rate of 86 ml/h is used, the lubricating oil is supplied at the rate of 11 ml/h and the rest of the discharged oil with respect the rate of 75 ml/h is returned to the lubricating oil tank.

What is claimed is;

1. A separated lubrication type two-cycle internal combustion engine system comprising:

an internal combustion engine having a crankshaft;

a lubricating oil tank;

a lubricating oil pump capable of discharging lubricating oil at a rate higher than the rate at which said internal combustion engine needs to be lubricated, said lubricating oil pump being disposed in the vicinity of one of projecting ends of said crankshaft, said lubricating oil pump having an inlet and a pair of outlets, said inlet communicating with said lubricating oil tank, one of said pair of outlets communicating with the interior of said internal combustion engine, the other of said outlets communicating with said lubricating oil tank; and a drive member disposed at said one of said projecting ends of said crankshaft is drivingly connected with said lubricating oil pump.

* * * * *